US010892122B2

(12) United States Patent
Law

(10) Patent No.: US 10,892,122 B2
(45) Date of Patent: Jan. 12, 2021

(54) TRIGGER ASSEMBLY WITH A PROTECTIVE COVERING

(71) Applicants: Defond Electech Co., Ltd, Guangdong (CN); Defond Components Limited, Chai Wan (HK)

(72) Inventor: Lap Yi Law, Chai Wan (HK)

(73) Assignees: DEFOND ELECTECH CO., LTD., Guangdong (CN); DEFOND COMPONENTS LIMITED, Chai Wan (HK)

( * ) Notice: Subject to any disclaimer, the term of this patent is extended or adjusted under 35 U.S.C. 154(b) by 0 days.

(21) Appl. No.: 16/536,142

(22) Filed: Aug. 8, 2019

(65) Prior Publication Data

US 2020/0343059 A1 Oct. 29, 2020

(30) Foreign Application Priority Data

Apr. 26, 2019 (HK) ..... 19123018.4

(51) Int. Cl.
*H01H 21/06* (2006.01)
*H01H 21/08* (2006.01)

(52) U.S. Cl.
CPC ..... *H01H 21/08* (2013.01); *H01H 21/06* (2013.01)

(58) Field of Classification Search
CPC ..... H01H 21/08; H01H 21/06; H01H 21/085; H01H 21/12; H01H 21/36; H01H 9/28; H01H 9/282; H01H 9/06; H01H 19/03; H01H 19/635; H01H 9/00; B25F 5/02; B24B 23/00; B24B 23/028; B24B 47/26
USPC ..... 200/50.11, 50.05, 522, 537, 318.1; 451/358, 354, 344
See application file for complete search history.

(56) References Cited

U.S. PATENT DOCUMENTS 3,881,081 A * 4/1975 Schilling ..... F16P 3/00 200/522
4,879,438 A * 11/1989 Winchester ..... H01H 9/06 200/61.85
7,186,940 B1 * 3/2007 Wong ..... H01H 1/18 200/522
7,291,796 B2 * 11/2007 Liu ..... H01H 1/2025 200/341
8,198,560 B2 * 6/2012 Kimata ..... H01H 3/20 200/318.1
8,653,919 B2 * 2/2014 Culp ..... A61B 17/32002 335/205

(Continued)

FOREIGN PATENT DOCUMENTS

CN 103280342 A 9/2013
CN 103415374 A 11/2013

(Continued)

OTHER PUBLICATIONS

Patentability Search Report of Chinese Patent Office for HK 19123018.4, dated May 15, 2019.

(Continued)

*Primary Examiner* — William A Bolton
(74) *Attorney, Agent, or Firm* — Bryan D. Zerhusen, Esq.; Nicholas R. Herrel, Esq.; Cantor Colburn LLP

(57) ABSTRACT

A covering for a trigger assembly of an electrical device, said covering being configured for at least partially covering a torsion spring of the trigger assembly so as to alleviate ingress of dust, water and other particulates in to contact with the torsion spring.

9 Claims, 4 Drawing Sheets

(56) References Cited

U.S. PATENT DOCUMENTS

| | | | | |
|---|---|---|---|---|
| 8,851,351 | B2 * | 10/2014 | Yeh | B25C 1/047 173/170 |
| 2013/0277189 | A1 | 10/2013 | Yuan | |
| 2014/0349556 | A1 | 11/2014 | Zhang et al. | |

FOREIGN PATENT DOCUMENTS

| | | | |
|---|---|---|---|
| DE | 10 2004 008 363 | A1 | 9/2004 |
| DE | 10 2012 103 935 | B4 | 3/2015 |
| DE | 10 2015 200 204 | A1 | 7/2015 |

OTHER PUBLICATIONS

DE Office Action; Application No. 102019120363.5; dated May 20, 2020; 3 pages.

* cited by examiner

TRIGGER ASSEMBLY WITH A PROTECTIVE COVERING

CROSS-REFERENCES TO RELATED APPLICATIONS

This application claims the benefit of Hong Kong Short Term Patent Application No. 19123018.4, filed 26 Apr. 2019, which is hereby incorporated by reference in its entirety.

BACKGROUND

1. Field of the Discovery

The disclosed embodiments relate to protective coverings for components of trigger assemblies which may be used to operate electrical devices such as power tools, gardening tools and the like.

2. Background Information

Electrical devices such as power tools will typically include a number of torsion springs to bias a lock-off, or lock-on member into a particular position. As the lock-off or lock-on member is normally disposed on a surface of the trigger assembly, the torsion spring is exposed to contact with moisture, dust and other particulates which may damage or otherwise compromise the functioning of the trigger assembly. As such, there is a perceived need for improvements to alleviate this problem so that the usable lifespan of the electric power tool is extended.

SUMMARY

The disclosed embodiments seek to alleviate at least one of the above-described problems.

The disclosed embodiments may involve several broad forms. The disclosed embodiments may include one or any combination of the different broad forms herein described.

In one broad form, the present disclosure provides a trigger assembly for use with an electrical device to operate said electrical device, said electrical device having an electric switch housing with an electrical switch unit disposed therein, the trigger assembly including; a trigger member configured for movement relative to the housing; an actuator member operably-connected to the trigger member and, responsive to movement of the trigger member relative to the housing, said actuator member being movable in a first direction relative to the housing from an OFF position in which the electrical switch is operably-opened by the actuator towards an ON position in which the electrical switch is operably-closed by the actuator, and, movable in a second direction relative to the housing from the ON position towards the OFF position; a locking assembly mounted on the trigger member, the locking assembly including a locking member configured for rotatable movement relative to the trigger member between a plurality of rotatable positions so as to enable selectable locking of the actuator member into either of the ON or OFF position depending upon the rotatable position of the locking member relative to the trigger member, the locking assembly further including a torsion spring operable with the locking member so as to urge the locking member towards at least one of the plurality of rotatable positions of the locking member relative to the trigger member; and a covering configured for at least partially covering the torsion spring to alleviate ingress of dust, water and other particulates in to contact with the torsion spring.

In certain embodiments, the covering may include a first curved portion configured for at least partially covering a main body of the torsion spring, and, a first attachment portion connected with the first curved portion wherein the first attachment portion is configured for attachment with the locking member such that when the locking member is rotated relative to the trigger member, the first curved portion is caused to freely rotate about the main body of the torsion spring.

In additional embodiments, the covering may include a second curved portion, a straight portion, and a second attachment portion, the second curved portion being connected with a first end of the straight portion, and the attachment portion being connected with a second end of the straight portion, wherein the second curved portion is configured to at least partially cover a portion of the main body of the torsion spring, the straight portion is configured to at least partially cover an arm of the torsion spring extending linearly away from the main body of the torsion spring, and wherein the second attachment portion is configured for attachment with the trigger member.

In certain embodiments, the first curved portion and the first attachment portion may be integrally formed together to form a first covering section, the second curved portion, the straight portion and the second attachment portion may be integrally formed together to form a second covering section, and the first and second covering sections may be separate from each other.

In additional embodiments, at least one of the first and second curved portions may include a tubular-shaped configuration.

In certain embodiments, the tubular-shaped configuration may include a slot extending along a wall of the tubular-shaped configuration via which the main body of the torsion spring can pass through to allow the tubular-shaped configuration to be fitted around the main body of the torsion spring and to at least cover a portion of the main body of the torsion spring.

In additional embodiments, at least one of the first and second attachment portions may be configured for effecting attachment by way of at least one of friction fitting attachment, force-fitting attachment, snap-fitting attachment, press-fitting attachment, adhesive attachment, clamped attachment, and screwed attachment.

In certain embodiments, the first and second covering sections may be formed from at least one of a rubber material and an elastomeric material.

In an additional aspect, the disclosure provides a covering for use with a trigger assembly of an electrical device, said covering being configured for at least partially covering a torsion spring of the trigger assembly so as to alleviate ingress of dust, water and other particulates in to contact with the torsion spring.

BRIEF DESCRIPTION OF THE DRAWINGS

The disclosed embodiments will become more fully understood from the following detailed description of a preferred but non-limiting embodiment thereof, described in connection with the accompanying drawings, wherein.

DETAILED DESCRIPTION

The disclosed embodiments will now be described herein with reference to FIGS. 1 to 4.

Figure 4:
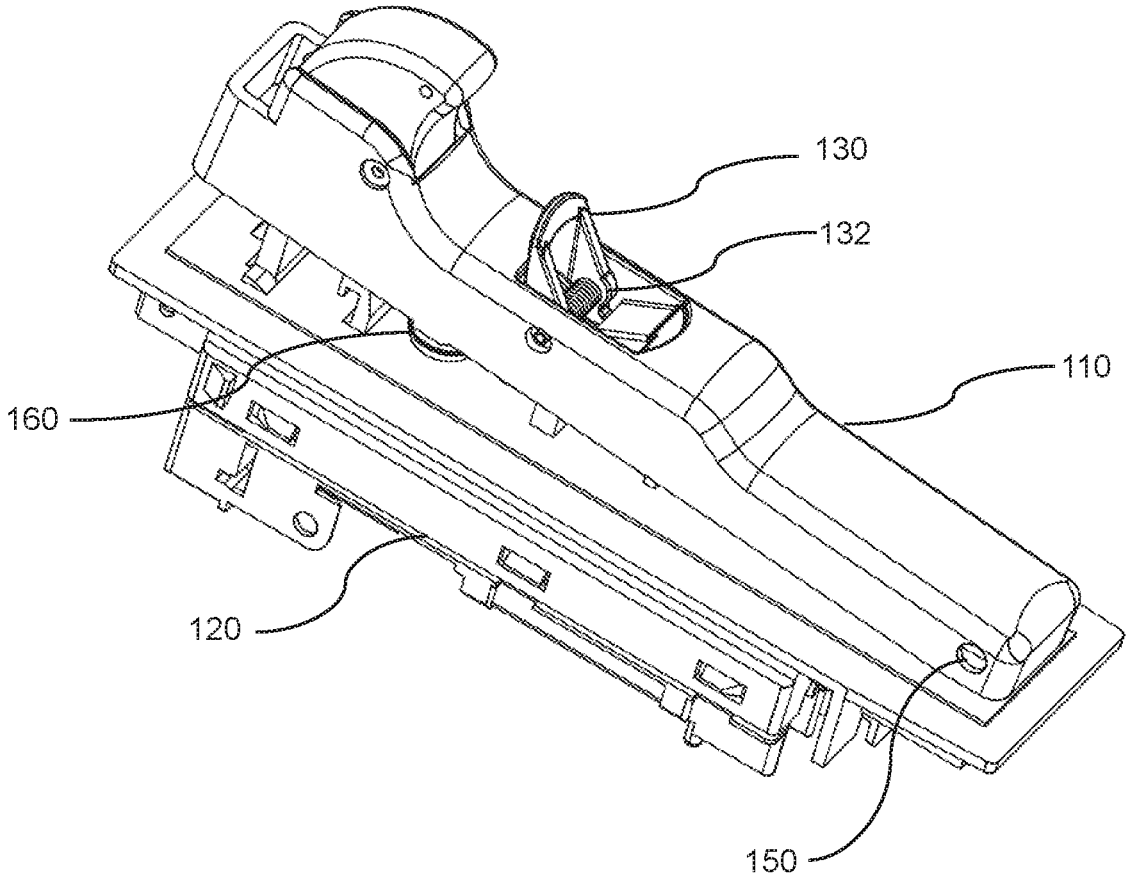
FIG. 4 shows a perspective view of an example trigger member hingedly coupled to an electrical contact housing of an electrical device, and to which a protective covering in accordance with the disclosed embodiments may be used to cover a torsion spring of the trigger member lock-off mechanism.

Referring firstly to FIG. 4, an example trigger assembly is shown for use with an electrical device to operate the electrical device. The electrical device in this example embodiment may be a hand-held power tool although the disclosed embodiments may be equally applicable for use in relation to any other type of electrical device or appliance, whether hand-held or not. The electrical device includes an electric switch housing (120) with an electrical switch unit disposed therein. The trigger assembly includes a trigger member (110) configured for rotational movement about a hinge (150) relative to the housing member (120). An actuator member (160) is operably-connected to the trigger member (110), whereby, in response to movement of the trigger member (110) relative to the housing (120), the actuator member (160) is movable in a first direction relative to the housing (120) from an OFF position (in which the electrical switch is operably-opened by the actuator) towards an ON position (in which the electrical switch is operably-closed by the actuator). The actuator member (160) is also movable, in response to movement of the trigger member (110), in a second direction relative to the housing (120) from the ON position towards the OFF position. When the electrical switch inside the housing (120) is operably-closed by the actuator m ember (160), the switch connects power from a power supply within the electrical device to a motor of the electrical device to drive operation of the electrical device and when the actuator member (160) operably-opens the electrical switch, the power supply is disconnected from the electric motor so that the electric device is non-operational.

Figure 3A:
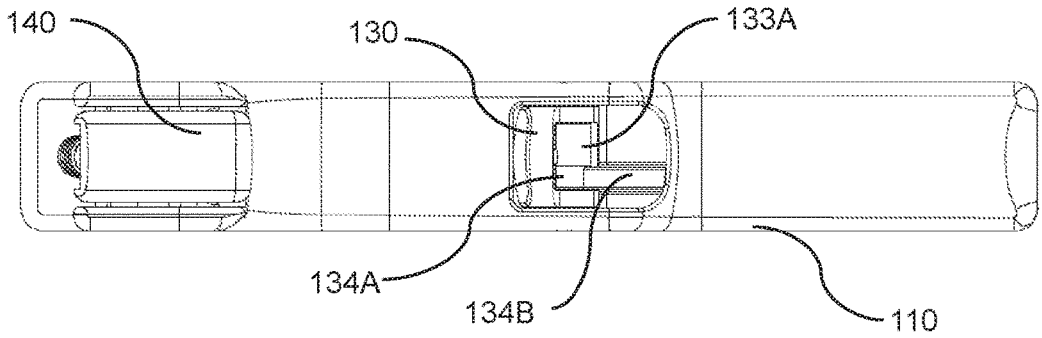
FIG. 3A shows a top view of the aspect of the trigger assembly of FIG. 1.
Figure 3B:
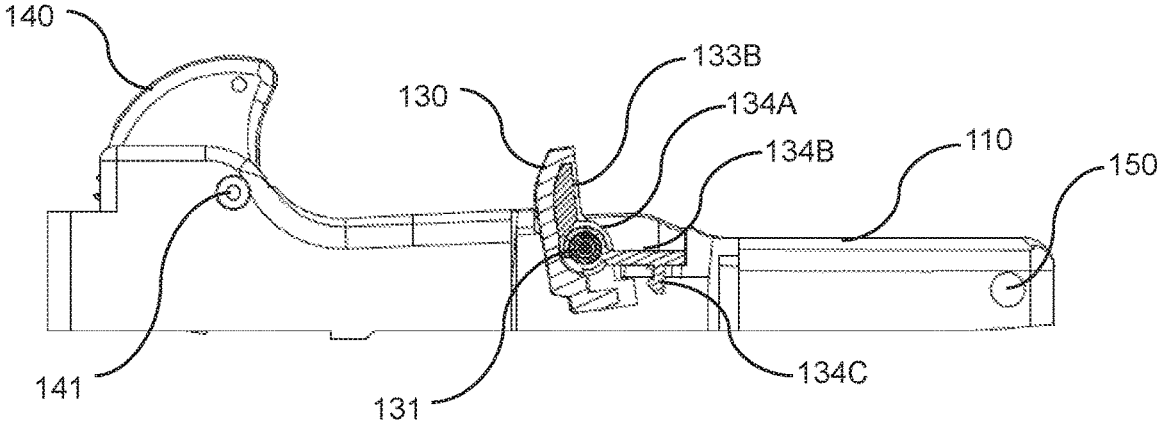
FIG. 3B shows a side view of the aspect of the trigger assembly of FIG. 1 wherein a locking member of the trigger assembly is arranged in a first rotatable position.
Figure 3C:
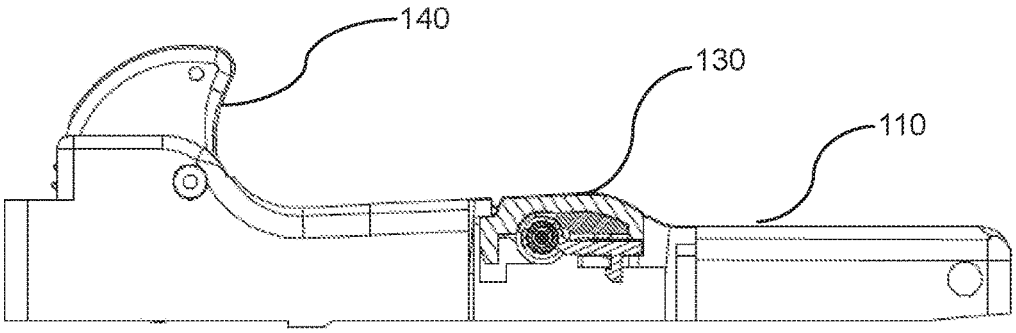
FIG. 3C shows a side view of the aspect of the trigger assembly of FIG. 1 wherein a locking member of the trigger assembly is arranged in a second rotatable position.

A locking assembly is mounted on an outer surface of the trigger member (110). The locking assembly includes a locking member (130) configured for rotatable movement relative to the trigger member (110) about a hinge (131). The locking member (130) rotates about the hinge (131) within a recess (111) disposed in the outer surface of the trigger member (110). The locking member (130) is rotatable between a plurality of rotatable positions so as to selectably "lock off" the actuator member (160) from closing the electrical switch depending upon the rotatable position of the locking member relative to the trigger member. For instance, in FIG. 3B the locking member (130) is shown rotated in to a first position in which the actuator member (160) is "locked off" that is, the trigger member (110) cannot be squeezed towards the housing (120) to cause the actuator member (160) to close the electrical switch of the electrical device. In FIG. 3C, the locking member (130) is shown rotated in to a second position in which the trigger assembly is not "locked off" and therefore the trigger member may be freely squeezed towards the electrical housing (120) in order for the actuator member (160) to close the electrical switch inside the housing (120).

The locking assembly also includes a torsion spring (132) operably-connected with the locking member (130) and surface of the trigger member (110) which is configured to urge the locking member (130) towards the second position (i.e. the non-locked-off position) as shown in FIG. 3C. The locking assembly includes a covering for covering the torsion spring (132) so as to alleviate exposure to water, dust and other particulates which may cause damage or otherwise cause malfunctioning of the torsion spring (132). The covering includes a first curved portion (133A) shaped and dimensioned for covering a main body (132A) of the torsion spring (132). In this embodiment the curved portion (133A) is tubular-shaped and complements a shape configuration of the torsion spring main body (132A). In this embodiment, the tubular-shaped configuration includes a slot extending along a wall of the tubular-shaped configuration via which the main body (132A) of the torsion spring (132) can pass through to allow the tubular-shaped configuration to be fitted around the main body (132A) of the torsion spring (132) and to at least cover a portion of the main body (132A) of the torsion spring (132). Depending upon the choice of material used to form the tubular-shaped configuration, the slot (132B) may have suitable amount of resilient flexibility to allow the main body (132A) of the torsion spring (132) to pass through the slot so as to be surrounded within the tubular-shaped configuration and whereby the main body (132A) of the torsion spring (132) then is securely retained within the tubular-shaped configuration. This makes it relatively quick and easy to fit the covering over the torsion spring (132) main body (132A) during manufacture and assembly of the electrical device.

Figure 1:
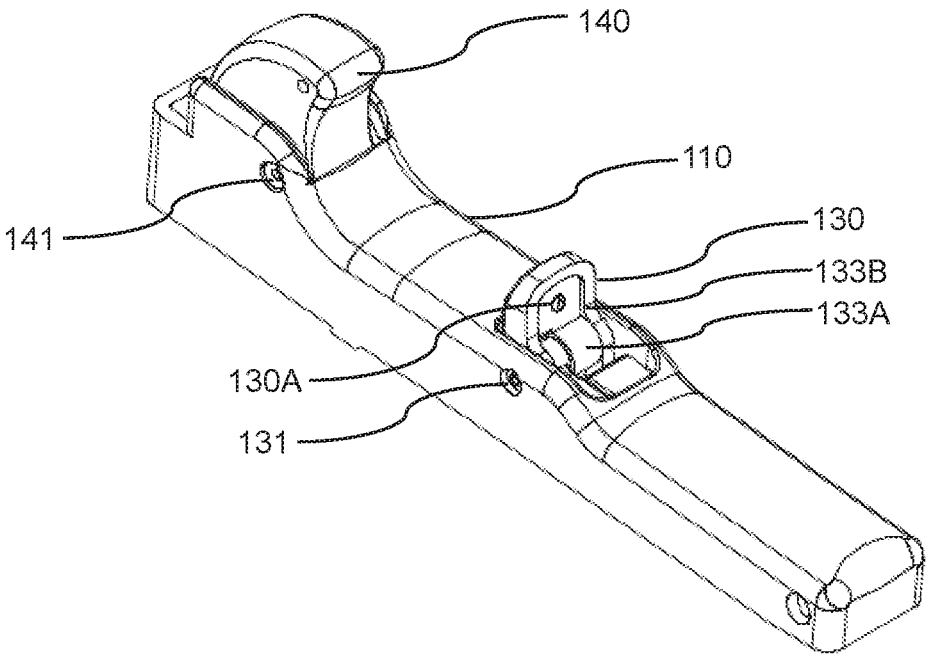
FIG. 1 shows a perspective view of a aspect of a trigger assembly with a covering fitted thereon for covering a torsion spring of the trigger assembly in accordance with one of the disclosed embodiments.
Figure 2:
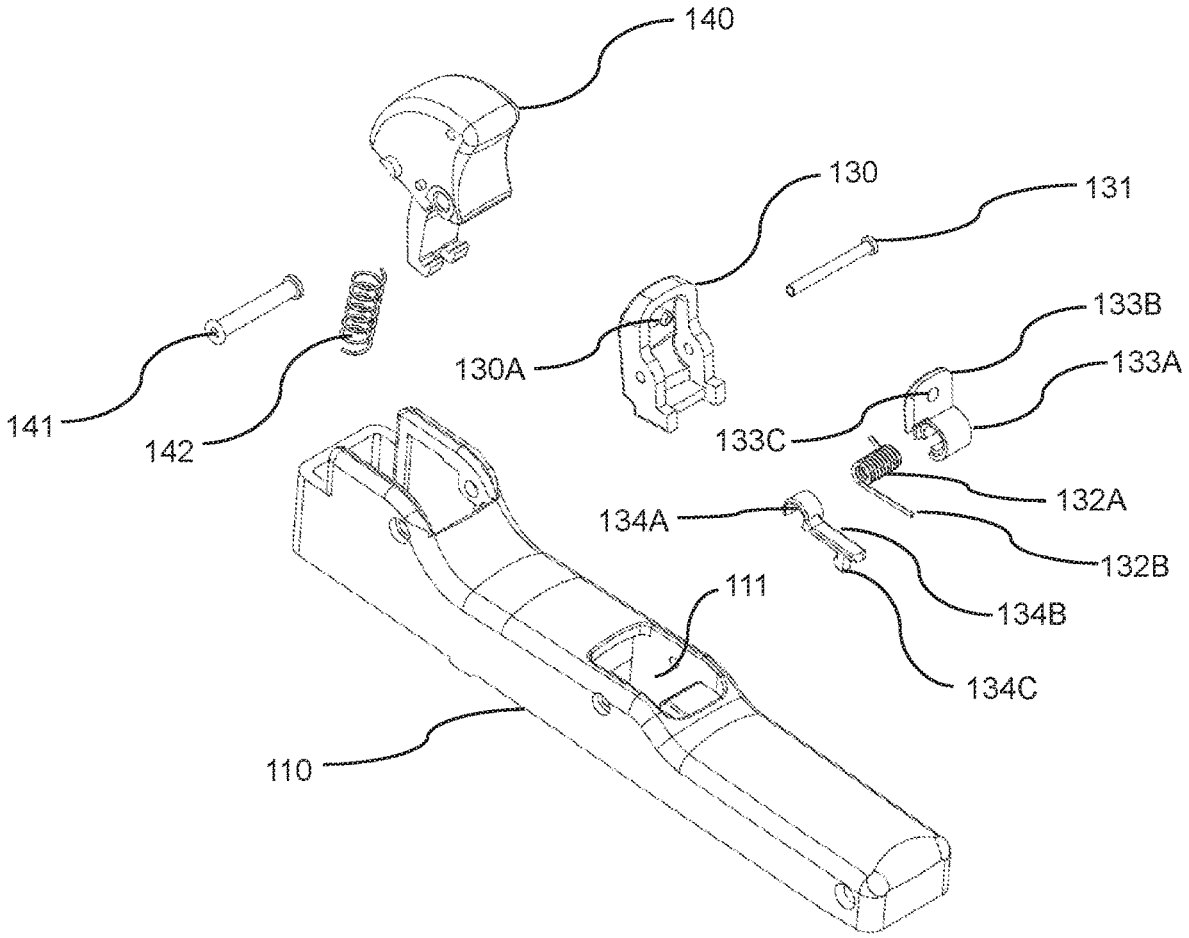
FIG. 2 shows an exploded perspective view of the aspect of the trigger assembly of in FIG. 1.

The first curved portion (133A) of the covering is integrally formed together with a first attachment portion (133B) of the covering. For instance, the covering may be formed as a single piece from an elastomeric material, a rubber material, a polymeric material, a plastic material, a metal material or any other suitable material. The first attachment portion (133B) is configured for secure and rigid attachment with a surface of the locking member (130) such as shown in FIG. 1 such that when the locking member (130) is rotated relative to the trigger member (110), the first curved portion (133A) is caused to freely rotate coaxially about the main body (132A) of the torsion spring (132). In this particular embodiment the attachment member (133B) includes a planar panel having an aperture (133C) disposed therein that is configured to be press-fitted on to a protrusion (130A) extending from a surface of the locking member (130) as shown in FIG. 2 whereby the first attachment portion (133B) is held securely and rigidly in place with the locking member (130). Alternately, any other suitable attachment means may be employed for this purpose such as for instance, friction-fitting attachment, force-fitting attachment, snap-fitting attachment, press-fitting attachment, adhesive attachment, clamped attachment, and screwed attachment.

A second covering is also provided which includes a second curved portion (134A), a straight portion (134B), and a second attachment portion (134C). The second curved portion (134A) is connected with a first end of the straight portion (134B), and the second attachment portion (134C) is connected with a second end of the straight portion (134B). The second curved portion (134A) is configured to substantially cover the torsion spring (132), the straight portion (134B) is configured to cover an arm (132B) of the torsion spring (132) extending linearly away from an end of the main body (132A) of the torsion spring (132) at an end of the main body (132A). The second attachment portion (134C) in this embodiment comprises a protrusion extending from the end of the straight portion (134B) which is configured for press-fitting engagement with an aperture disposed in a surface of the trigger member (110) so as to effect securement. Conveniently, the second covering complements the first covering so that together they may substantially prevent exposure of the torsion sprint (132) surface area from contaminants.

The locking assembly also includes a lock-on assembly for selectably locking the trigger assembly in to the ON position so that the user need not maintain finger pressure on the trigger member (110). The lock-on assembly is operable independently and separately from the lock-off assembly and includes a lock-on member (140) that is rotatable about a hinge (141) relative to the trigger member (110) and is biased in to a non-locked-on position by a return spring (142).

It will be appreciated that the disclosed embodiments may assist in providing at least one of the following advantages of the existing art:

the covering provides protection for the torsion spring from dust, water and other particulates which may cause damage to the torsion spring over time, for instance due to corrosion. Hence this assists in extending the usable lifespan of the electrical device;

the novel design configuration of the covering provides a relatively compact form-factor which is well-suited for use in particular with hand-held power tools where efficient utilisation of space is important;

the covering is relatively easy to produce, for instance by relatively simple molding techniques, and is relatively easy to assemble in place on to the locking member as it may for instance be easily fitted over the torsion spring body and snap-fitted in to secure attachment so that it is not readily able to be dislodged during ordinary use of the electrical device.

Those skilled in the art will appreciate that the disclosed embodiments are susceptible to variations and modifications other than those specifically described without departing from the scope of the present disclosure. All such variations and modification which become apparent to persons skilled in the art, should be considered to fall within the spirit and scope of the disclosure as broadly hereinbefore described. It is to be understood that the disclosure includes all such variations and modifications. The disclosure also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A trigger assembly for use with an electrical device to operate said electrical device, said electrical device having an electric switch housing with an electrical switch unit disposed therein, the trigger assembly including;

a trigger member configured for movement relative to the housing;

an actuator member operably-connected to the trigger member and, responsive to movement of the trigger member relative to the housing, said actuator member being movable in a first direction relative to the housing from an OFF position in which the electrical switch is operably-opened by the actuator member towards an ON position in which the electrical switch is operably-closed by the actuator member, and, movable in a second direction relative to the housing from the ON position towards the OFF position;

a locking assembly mounted on the trigger member, the locking assembly including a locking member configured for rotatable movement relative to the trigger member between a plurality of rotatable positions so as to enable selectable locking of the actuator member in to either of the ON or OFF position depending upon the rotatable position of the locking member relative to the trigger member, the locking assembly further including a torsion spring operable with the locking member so as to urge the locking member towards at least one of the plurality of rotatable positions of the locking member relative to the trigger member;

a covering that is separately formed from the locking member, the covering being configured to complement a shape contour of the torsion spring, and, being configured for fitting around the torsion spring so as to alleviate ingress of dust, water and other particulates in to contact with the torsion spring; and whereby, the covering is configured to freely rotate about the torsion spring when fitted around the torsion spring and when the locking member is rotated relative to the trigger member.

2. The trigger assembly as claimed in claim 1 wherein the covering includes a first curved portion configured for at least partially covering a main body of the torsion spring, and, a first attachment portion connected with the first curved portion wherein the first attachment portion is configured for attachment with the locking member such that when the locking member is rotated relative to the trigger member, the first curved portion is caused to freely rotate about the main body of the torsion spring.

3. The trigger assembly as claimed in claim 2 wherein the covering includes a second curved portion, a straight portion, and a second attachment portion, the second curved portion being connected with a first end of the straight portion, and the second attachment portion being connected with a second end of the straight portion, wherein the second curved portion is configured to at least partially cover a portion of the main body of the torsion spring, the straight portion is configured to at least partially cover an arm of the torsion spring extending linearly away from the main body of the torsion spring, and wherein the second attachment portion is configured for attachment with the trigger member.

4. The trigger assembly as claimed in claim 3 wherein the first curved portion and the first attachment portion are integrally formed together to form a first covering section, the second curved portion, the straight portion and the second attachment portion are integrally formed together to form a second covering section, and the first and second covering sections are separate from each other.

5. The trigger assembly as claimed in claim 1 wherein at least one of the first and second curved portions include a tubular-shaped configuration.

6. The trigger assembly as claimed in claim 5 wherein the tubular-shaped configuration includes a slot extending along a wall of the tubular-shaped configuration via which the main body of the torsion spring can pass through to allow the tubular-shaped configuration to be fitted around the main body of the torsion spring and to at least cover a portion of the main body of the torsion spring.

7. The trigger assembly as claimed in claim 3 wherein at least one of the first and second attachment portions are configured for effecting attachment by way of at least one of friction fitting attachment, force-fitting attachment, snap-fitting attachment, press-fitting attachment, adhesive attachment, clamped attachment, and screwed attachment.

8. The trigger assembly as claimed in claim 4 wherein the first and second covering sections are formed from at least one of a rubber material and an elastomeric material.

9. A covering for use with a trigger assembly of an electrical device in accordance with claim 1.

* * * * *